US007713149B2

(12) United States Patent
Docherty

(10) Patent No.: US 7,713,149 B2
(45) Date of Patent: May 11, 2010

(54) BASKETBALL BACKBOARD TARGET

(76) Inventor: Mike Docherty, 19453 Estuary Dr., Boca Raton, FL (US) 33498

( * ) Notice: Subject to any disclaimer, the term of this patent is extended or adjusted under 35 U.S.C. 154(b) by 147 days.

(21) Appl. No.: 12/079,005

(22) Filed: Mar. 24, 2008

(65) Prior Publication Data

US 2008/0234074 A1 Sep. 25, 2008

Related U.S. Application Data

(60) Provisional application No. 60/919,811, filed on Mar. 24, 2007.

(51) Int. Cl.
*A63B 69/00* (2006.01)
*A63B 67/00* (2006.01)
*A63B 63/08* (2006.01)

(52) U.S. Cl. ..... 473/447; 473/422; 473/472; 473/480

(58) Field of Classification Search ..... 473/434, 473/447, 448, 472, 479–484; 434/248; D21/699, D21/701–704
See application file for complete search history.

(56) References Cited

U.S. PATENT DOCUMENTS 2,805,861 A * 9/1957 Lopas ..... 473/472
3,137,502 A * 6/1964 Duganich ..... 473/481
4,183,522 A * 1/1980 Killen ..... 473/483
5,305,998 A * 4/1994 Nesbit et al. ..... 473/481
5,695,415 A 12/1997 Docherty et al.
5,800,296 A * 9/1998 Shaw ..... 473/483
5,829,751 A * 11/1998 Willis ..... 273/330
6,070,879 A * 6/2000 Kemp ..... 273/317.5
6,554,724 B2 * 4/2003 Taylor ..... 473/447
6,758,768 B2 7/2004 Spencer
6,984,129 B1 * 1/2006 Jordan ..... 473/481
7,056,242 B2 * 6/2006 Tsinberg ..... 473/481
2001/0024984 A1 * 9/2001 Stanford et al. ..... 473/484
2001/0040803 A1 * 11/2001 Branson ..... 362/234
2002/0049102 A1 * 4/2002 Taylor ..... 473/447
2003/0216195 A1 * 11/2003 Britto et al. ..... 473/481
2007/0072159 A1 * 3/2007 Olson ..... 434/252
2008/0004139 A1 * 1/2008 Jang ..... 473/481

* cited by examiner

*Primary Examiner*—Mitra Aryanpour
(74) *Attorney, Agent, or Firm*—Lawrence Shurupoff

(57) ABSTRACT

A static aiming target for perfecting basketball bank shots appears to move horizontally and vertically along a backboard as a player moves back and forth across the court and towards and away from the backboard. This apparent movement of the aiming target is produced by visual aiming regions which allow for predetermined viewing of portions of the aiming target as a function of a player's position on the court. In each case, a player shoots for the aiming target in order to complete a proper bank shot.

12 Claims, 8 Drawing Sheets

BASKETBALL BACKBOARD TARGET

CROSS REFERENCE TO RELATED APPLICATION

This application is related to U.S. Provisional Application No. 60/919,811 Filed Mar. 24, 2007 from which priority is claimed, and which is hereby incorporated by reference in its entirety.

BACKGROUND

This disclosure relates to a targeting system for improving the bank shot accuracy and "muscle memory" of a basketball player. The targeting system can provide both horizontal and vertical bank shot targets. While some bank shot targets have provided horizontal aiming guidance, none are known to provide targets which appear to move vertically with respect the hoop and backboard as a player moves around a basketball court.

SUMMARY

A factor in developing a targeting system described herein is that a preferred entry angle for a basketball passing through the horizontal plane of a basketball hoop is about 45 degrees. In accordance with this disclosure, it has been determined that this entry angle can effectively range from about 35 degrees to about 55 degrees, and preferably from 38 degrees to 52 degrees.

It has been found that using a 45 degree angle of attack as the desired entry angle into the hoop, a targeting system can be developed which can well accommodate basketball players of varying heights with little or no adjustments of the targeting system. That is, when using a 45 degree angle of attack into an imaginary basket located behind the backboard (as described in my U.S. Pat. No. 5,695,415), the player's height and distance from the backboard become less of a factor in providing a target for vertical aiming than if other entry angles are used. No matter the player's height or distance from the backboard, the player should shoot the basketball so that its parabolic flight enters an imaginary basket hoop at about 45 degrees, as described further below.

When constructing a targeting system as described herein, the use of a nominal 45 degree entry angle into a virtual hoop located behind the backboard requires a relatively limited amount of vertical adjustment of the aiming target. That is, the point along the vertical or y axis at which the basketball intersects the plane of the backboard varies less than might be expected. This vertical range is very small for a player shooting from the center of the court and becomes slightly larger as a player moves toward the sidelines of the court.

The aforementioned features and advantages of the disclosure will be pointed out with particularity, and will become clear from the following more detailed description taken in conjunction with the accompanying drawings, which form an integral part thereof.

BRIEF DESCRIPTION OF THE DRAWINGS

In the drawings.

In the various views of the drawings, like reference numerals designate like or similar parts.

DESCRIPTION OF THE EMBODIMENTS

Figure 1:
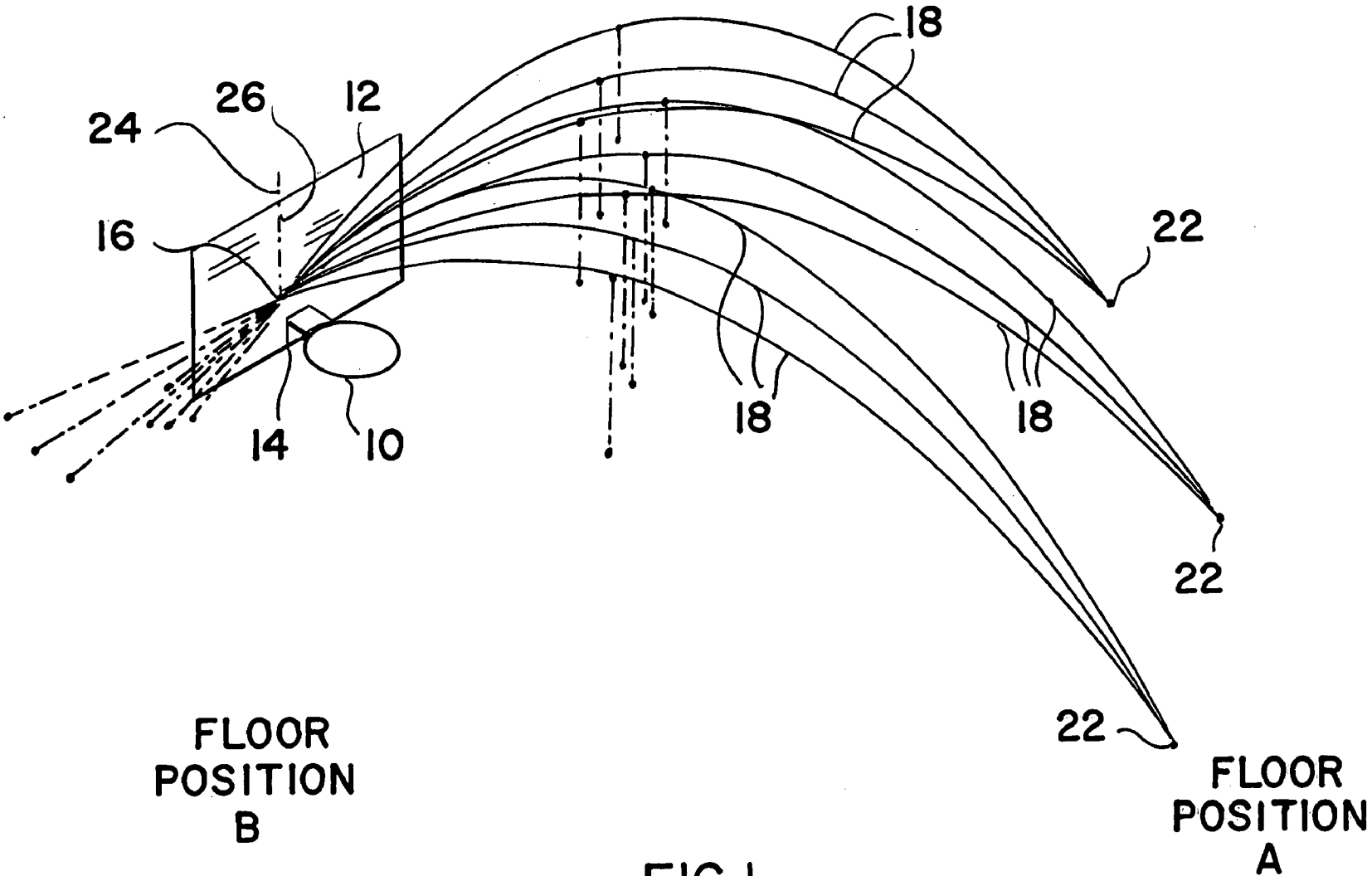
FIG. 1 is a schematic perspective view of a basketball court showing various basketball trajectories used to derive the targeting systems of FIGS. 2-15.

The calculation of a target profile on the plane of the backboard can be accomplished using three dimensional software to create virtual free throw trajectories along parabolic arcs from various points covering the floor of a virtual basketball court. As seen in FIG. 1, these free throws are calculated to enter a virtual basket hoop positioned behind the backboard, as further described in my U.S. Pat. No. 5,695,415. The center of the virtual hoop is typically located about five to six inches behind the backboard, and within the same horizontal plane as the actual basketball hoop located in front of the backboard.

While the angle of entry of the virtual ball into the virtual hoop is nominally 45 degrees, free throw calculations were made over a range of entry angles from 35 degrees to 45 degrees. The scatter or pattern of points at which these free throws intersect the front plane of the backboard on their way to the virtual hoop define a pair of upwardly extending, laterally-diverging and somewhat trapezoidal target areas as shown in FIG. 2.

Figure 2:
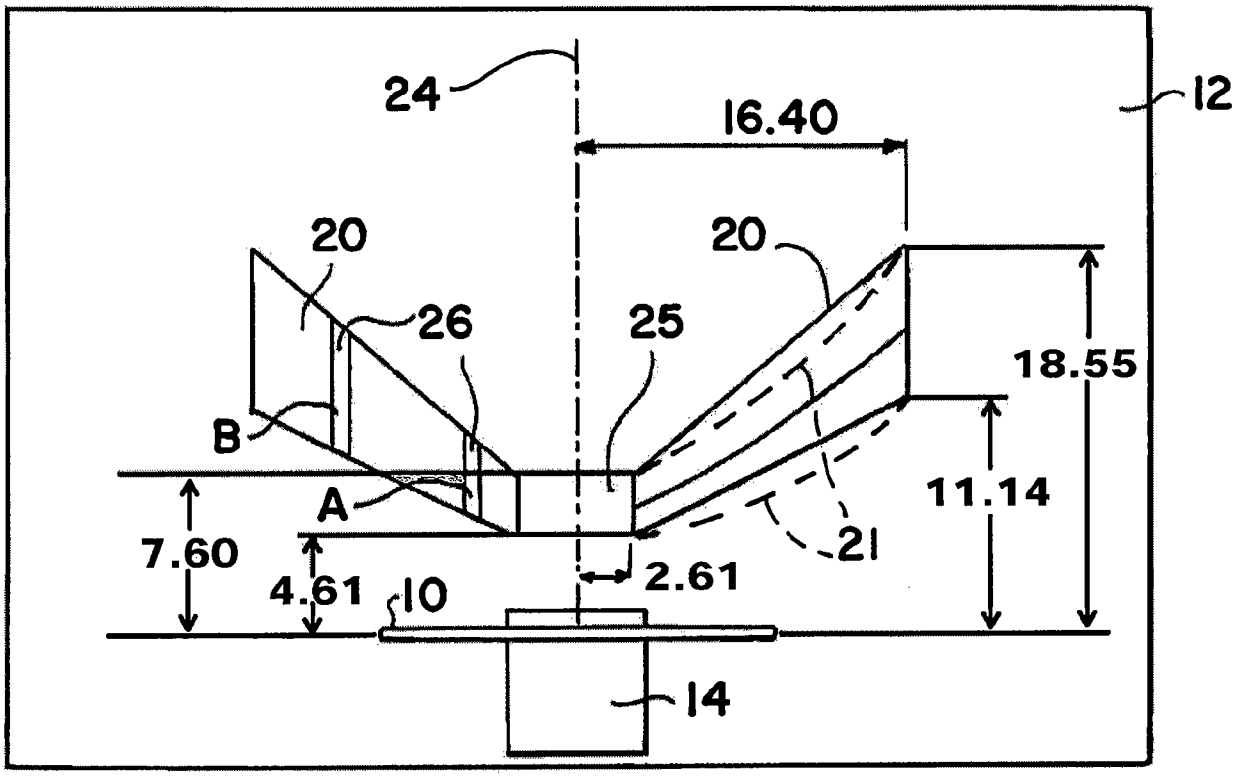
FIG. 2 is a front elevation view of the backboard of FIG. 1 showing the development of target areas on the plane of the backboard.
Figure 4:
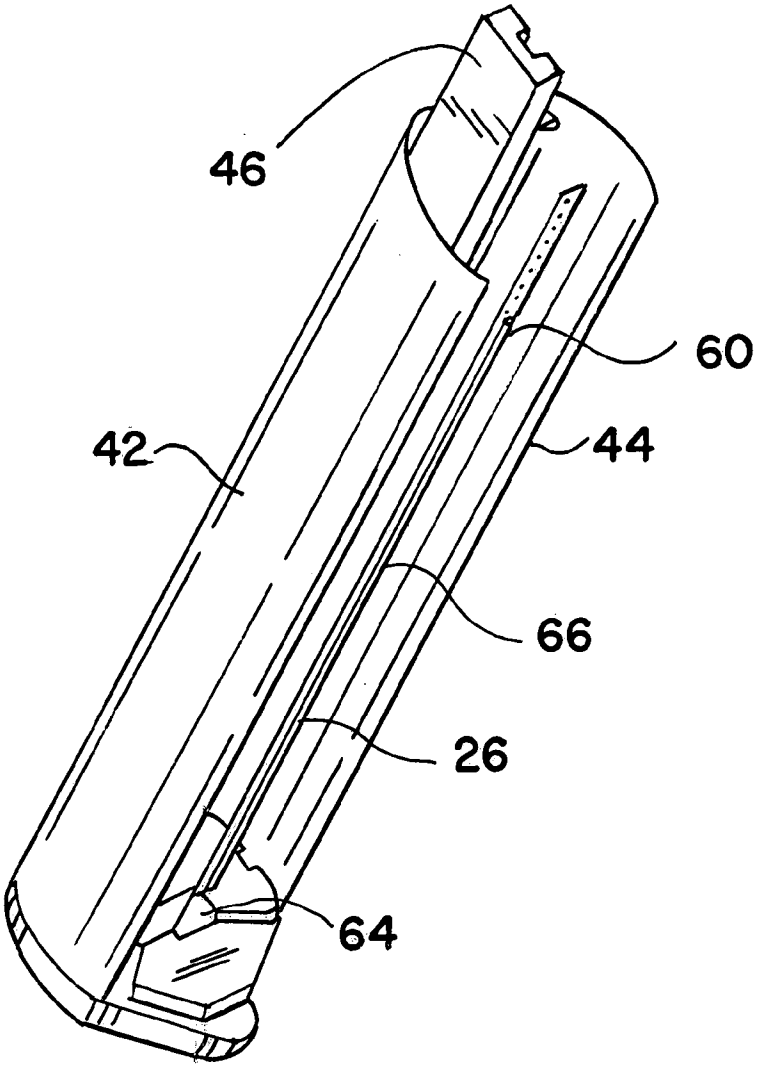
FIGS. 4, 5 and 7 are partial perspective views of FIG. 3 with certain components removed to show interior constructions.

As further seen in FIGS. 1 and 2, a basketball hoop or rim 10 is mounted in a known fashion to a planar backboard 12 by an L-shaped angle bracket 14. The center 16 of a virtual hoop is located behind backboard 12 and serves as the point through which each virtual free throw passes. The paths 18 (FIG. 1) of representative free throws intersect backboard 12 along their way to the center of the virtual hoop 16 and form a distribution of contact points within a pair of target regions or light apertures 20 on the front surface of the backboard. The locations and dimensions of the regions 20 on backboard 12 are represented in FIG. 2 in inches. While regions 20 are shown as trapezoids, other polygonal regions can be used, as can nonliner regions such as represented by dashed region lines 21 in FIG. 2.

The three parabolic paths 18 from each free throw location 22 in FIG. 1 respectively represent virtual hoop entry angles of 35 degrees, 45 degrees and 55 degrees. Other values can, of course be used. The selected ball release height of the free throws can vary for the purpose of determining the location of the resulting target regions 20, but values around six feet above the floor of the court produce realistic parabolic paths similar to those produced by live basketball players.

Once the target regions 20 have been defined or modeled as described above, an actual target is needed that duplicates or simulates the area or boundary of region 20 on the surface of backboard 12. While simply duplicating regions 20 directly on the backboard 12 with a static covering such as paint, lamination sheets or other indicia will provide some aiming assistance to a basketball player, it is helpful to provide an additional aiming target that appears to move horizontally or laterally across the regions 20 as a basketball player likewise moves horizontally or laterally across the floor of the basketball court.

The lateral or horizontal location of such an apparently "moving" target within region 20 provides the proper horizontal or lateral location for targeting a bank shot, while the vertical height range of region 20 at each horizontal or transverse location provides the proper vertical range of targeting for a bank shot. Each region 20 extends upwardly and outwardly from the central portion 25 of the backboard 12 and increases in vertical height from the central portion or region 25 outwardly toward the sides of the backboard 12.

Previous aiming devices have been located either on the plane of the backboard as in U.S. Pat. No. 5,695,415, or behind the plane of the backboard as in U.S. Pat. No. 6,758,768. These aiming devices do not provide a target which appears to move vertically as a player moves laterally between the sidelines of the court. As described below, horizontal and vertical targeting limits for bank shots can be placed or displayed directly on the front or back surfaces of the backboard, preferably on the back or rear surface, using lenticular films. In another embodiment, a stand-alone targeting system can be mounted behind a standard "clear", transparent or otherwise light transmissible backboard such as those in common use. No modification of the backboard is required.

In another embodiment, the backboard 12 is modified so that only regions 20 are clear or transparent or light transmissible, and the remainder of the backboard is opaque or sufficiently semi-opaque enough to prevent visual detection of an aiming target located behind the backboard. In this case, a mask, coating, or curtain can be applied to the rear surface of the backboard 12 with cut-out or "see-through" portions defining the target regions 20. While the use of an aiming target is preferred, as discussed below, aiming regions 20 can be used without an aiming target.

A visible aiming target, such as a vertical pole, light strip, light bar, light pipe, fluorescent tube, neon tube or any other type of visible vertical target can extend vertically through virtual hoop center 16 (FIG. 1) along vertical axis 24. This simple inexpensive target is advantageously positioned at about 5.7 inches behind the front plane of backboard 12 and located along a line perpendicular to the backboard and bisecting the hoop 10.

As a player moves laterally back and forth (from side to side) across the basketball court, the apparent position of the aiming target moves back and forth across the region 20 as seen by a player on the court so as to provide the proper position for a bank shot at all locations on the court, wherever bank shots are proper. As shown schematically in FIG. 2, a vertically-extending target 26, located on axis 24 about 5.7 inches behind the backboard 12, will appear through the target region 20 as a visible vertical target line to a player positioned near, but not at the middle of the court floor, such as at position A (FIG. 1).

The target 26 identified as "A" in FIG. 2, will appear close to the middle or central portion of the backboard 12 at a corresponding position A (FIG. 2). The opaque central region 25 located laterally between the target regions 20 blocks a player's view of the target from some central court locations, thereby indicating that a bank shot is not appropriate when a player cannot see the target 26, such as when a player is directly in front of the hoop 10.

As the player moves away from the middle or central portion of the basketball court, in this example toward the left sideline, the target 26, although stationary, will appear to move horizontally to the left, such as at position B in FIG. 2. In each case, the player aims for the target 26 as seen through target region 20 to complete a successful bank shot.

Target 26 can be mounted in any suitable fashion behind the backboard 12 of FIG. 2 using brackets, braces, and/or linkages, as desired. This allows for easy on and off functionality of the aiming target 26 as it may be folded down, removed, turned or otherwise moved out of view when targeting is not desired. A schematic representation of a simple mounting arrangement for target 26 and its associated aiming aperture board or mask 100 is shown in FIG. 16.

A stand-alone integral targeting system 30 is shown in FIGS. 3 through 11. This system does not require any modification to existing transparent basketball backboards. This system is essentially a light box which is mountable behind a basketball backboard. System 30 includes an outer housing 32 which can be opaque or semi-opaque to light. Housing 32 serves as a mask to mask certain portions of target 26 as discussed below. A pair of end caps 34 prevents light from escaping the ends of the housing 32 and provides structural integrity to the system. The housing 32 includes a pair of front walls 36, 38 which diverge outwardly and rearward from a central rounded leading edge 40 located within the opaque region 25. The front walls 36, 38 extend into a pair of rear walls 42, 44 (FIG. 4) so as to form a substantially closed tubular housing 32.

Figure 6:
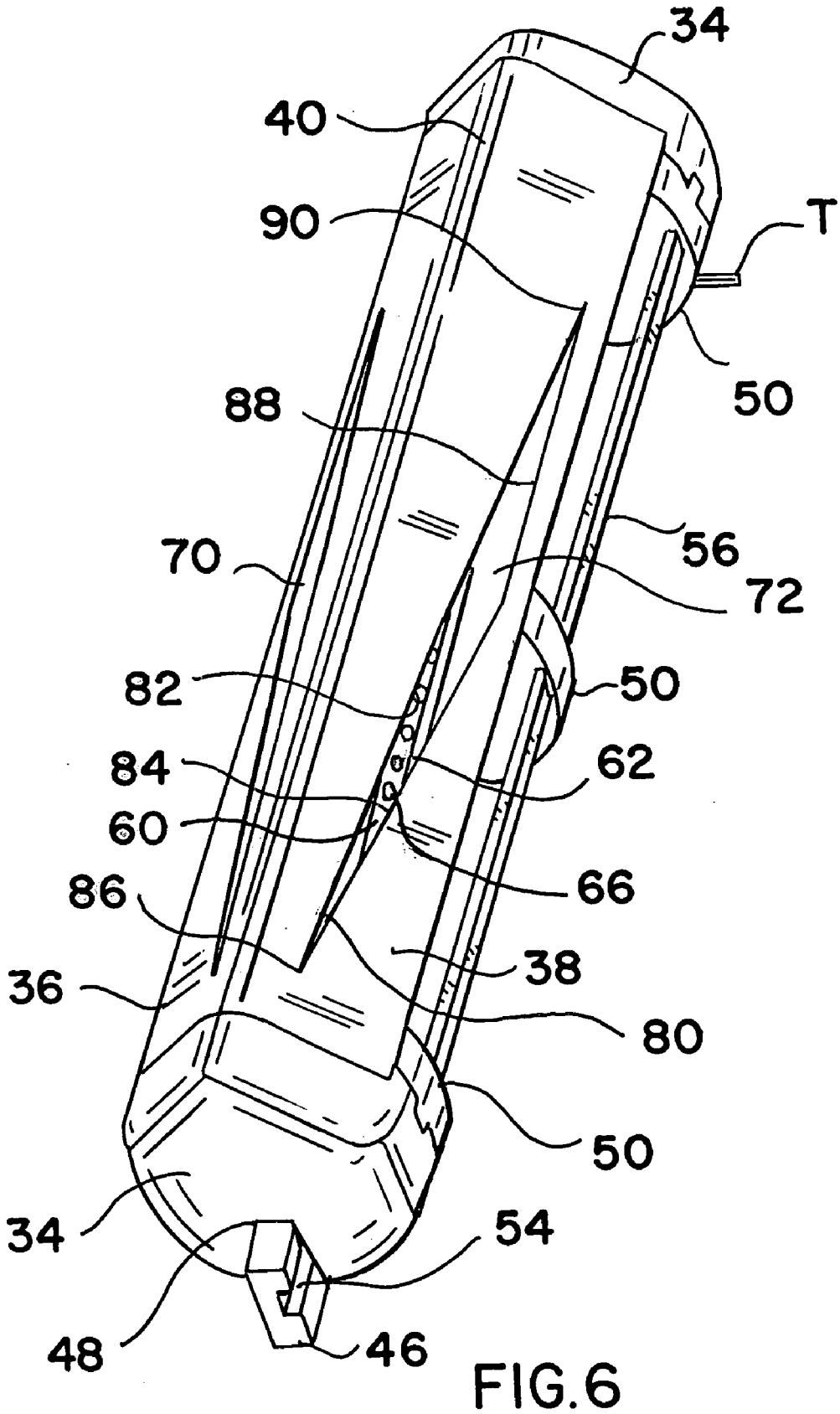
FIG. 6 is a bottom perspective view of FIG. 3 with outer wall portions removed to show internal constructions.
Figure 10:
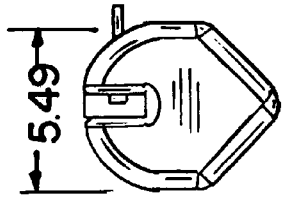
FIG. 10 is a top plan view of FIG. 3.
Figure 11:
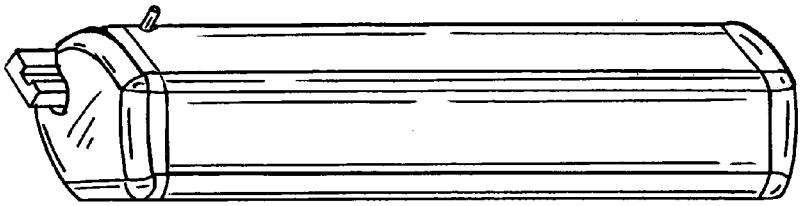
FIG. 11 is a top perspective view of FIG. 3, slightly rotated.
Figure 9:
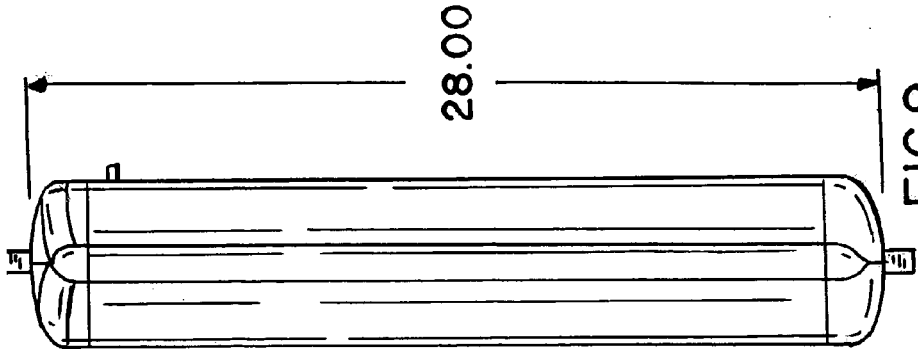
FIG. 9 is a front elevation view of FIG. 3.
Figure 8:
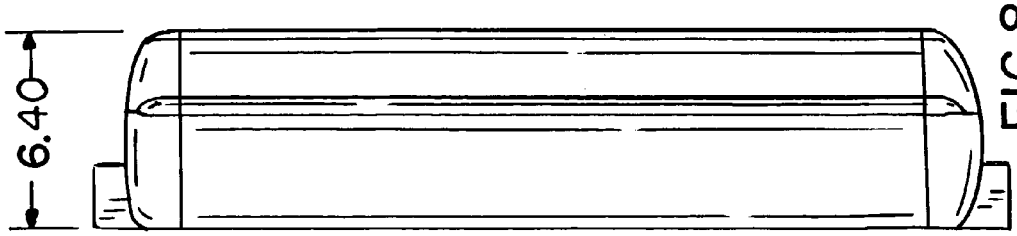
FIG. 8 is a left side elevation view of FIG. 3.
Figure 16:
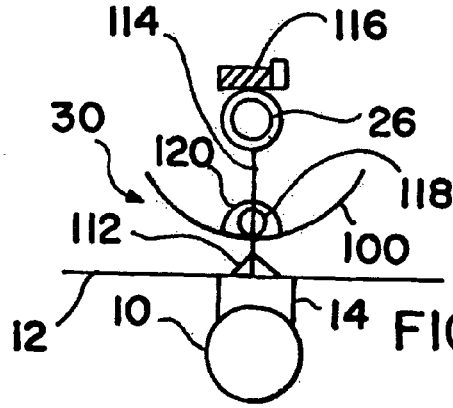
FIG. 16 is a schematic top plan view of the targeting system of FIG. 13 mounted behind a backboard.

A vertical mounting rail 46 is adapted to be connected to additional mounting structure fixed to a basketball backboard such as a mounting bar 114 shown in FIG. 16. Rail 46 is further adapted to fit within a slideway formed on or in housing 32. The slideway can be defined by a longitudinally-extending opening or channel 48 formed through each end cap 34 and through a series of longitudinally-spaced brace plates 50 (FIG. 6).

One or more set screws 52 (FIG. 7) threaded through each brace plate 50 can be selectively adjusted with a hand tool T (FIG. 6) by loosening and tightening against and within a groove 54 (FIG. 6) extending along the mounting rail 46. This adjustment allows the housing 32 to be adjusted vertically (up and down) along the mounting rail 46 to optimize the location of the vertical aiming component of the targeting system 30. That is, the housing 32 can be adjusted downwardly for shorter players and upwardly for taller players.

The housing 32 further includes a pair of side beams 56 (FIG. 6) extending along and against the inner surface of each respective rear wall 42, 44 for proving additional strength and stiffness to the system 30. Further strength is provided by a rectangular light support bar 62 (FIG. 6) that is fitted into a mating pocket 64 (FIG. 4) in each end cap 34. Support bar 62 is removed from FIG. 4, and FIG. 7 for clarity As further seen in FIG. 6, a longitudinally-extending light source such as a light bulb, light bar, light strip, light pipe, light tube or a linear series of small lights such as a strip of light emitting diodes (LEDs) 66 is mounted to the vertical light support bar 62. Suitable controls and circuitry can be provided to power the light source 60 on and off as desired, either directly or by remote control.

First and second light passages or apertures 70, 72 (FIG. 3) are provided in the respective front walls 36, 38 of the housing 32 to provide a horizontally and vertically varying aiming target 26 (FIG. 2), by providing visibility to the target light source 60 (FIG. 5) only within the target regions 20 of FIG. 2.

Although the light source 60 is fixed in position, it appears to be moving up and down and back and forth as viewed by a player moving over and around the court. The apertures 70, 72 reproduce or project the target regions 20 of FIG. 2 as seen through a clear glass or plastic backboard. These target regions 20 created or defined by the apertures 70, 72 are limited by upper and lower borders or boundaries which extend upwardly and laterally outwardly as a pair of wings from an interior central portion 25 of the backboard to define a somewhat "\ /"-shaped (open V) target region.

In order to produce a target 26 which is substantially confined to visibility within backboard regions 20 by a player on the court, simple trigonometry and descriptive geometry can be used to calculate the shapes and locations of light apertures or light passages 70, 72 which define the limits of target visibility to a player. A central V-shaped region 25, which extends vertically between the apertures 70, 72, blocks a player's view of the aiming target 26 when a player is near or at the center of the court (midway between the sidelines). That is, when a player is directly facing the hoop 10, a "swoosh" shot directly through the hoop is generally preferred over a bank shot.

Figure 3:
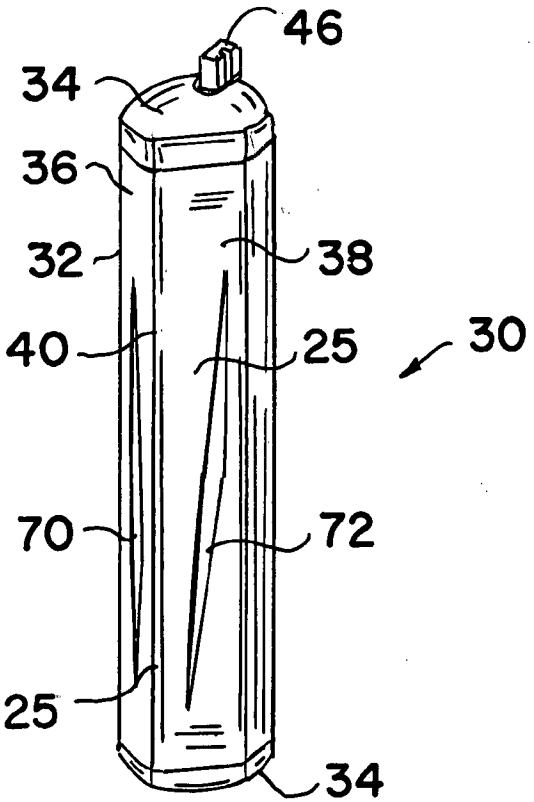
FIG. 3 is a front perspective view of one embodiment of a basketball aiming target having an enclosed housing.
Figure 7:
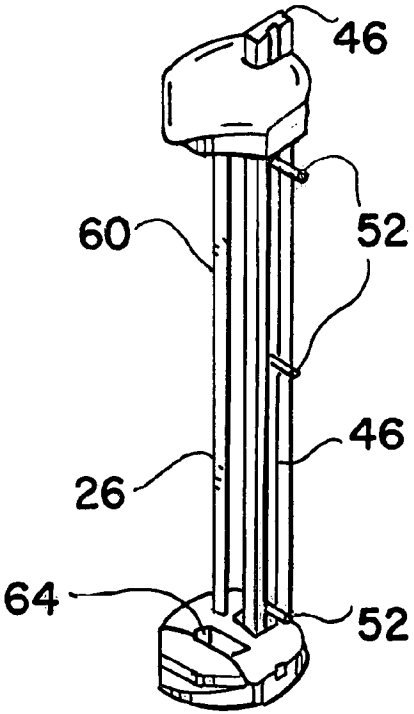
Figure 5:
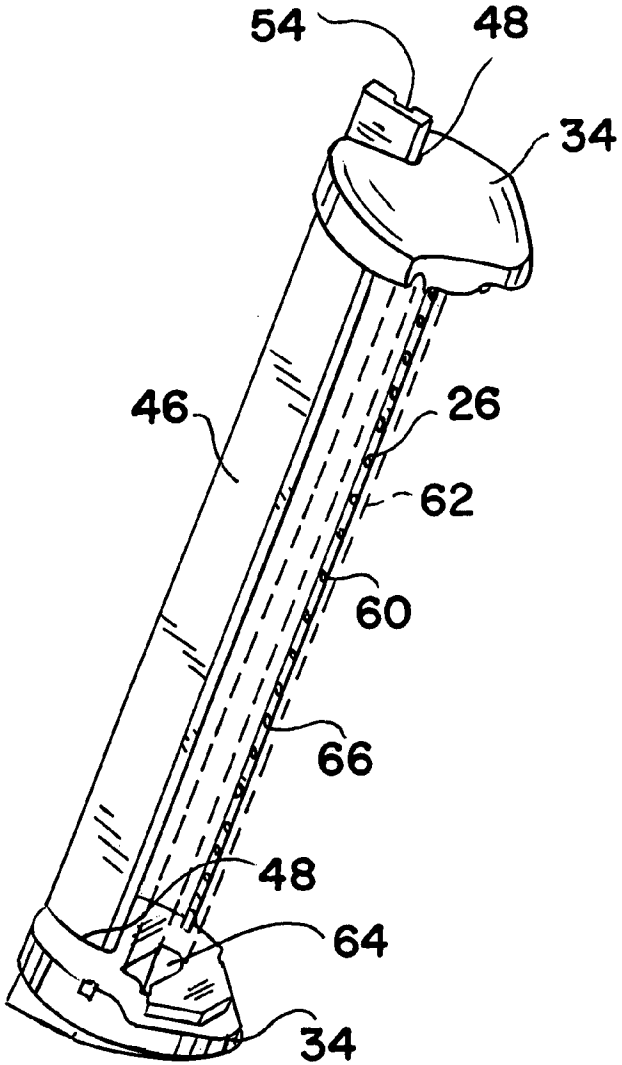

As seen in FIGS. 3 and 6, each light passage 70, 72 can be formed as a simple opening or cutout in the respective front walls 36, 38 of housing 32. If desired, a light-transmitting covering or lens (not shown) can be provided over each light passage 70, 72. If further desired, the lenses may each include a "flocked" or opaque matrix of dots which partially or substantially block visibility to the light source 60 when the light source is extinguished. This provides a convenient means for selectively displaying the target 26 during practice and for removing the target from sight during game play without having to move the targeting system 30.

In the representative embodiment of FIGS. 3-7, each light passage 70, 72 is defined by a relatively short lower vertical side wall 80 (FIG. 6) located adjacent the leading edge 40. Wall 80 transitions upwardly into a longer upwardly and rearwardly extending side wall 82. An upwardly and rearwardly extending sidewall 84 forms a bottom apex 86 with the bottom of the lower side wall 80 and joins a vertically-extending upper sidewall 88 at the upper end of sidewall 84.

Sidewall 88 is substantially parallel with sidewall 80, and extends upwardly to meet sidewall 82 at an upper apex. With this design, the light passages or, apertures 70, 72 are defined by trapezoidal openings. In this embodiment, the apertures 70, 72 extend upwardly and rearwardly in a wing-like configuration, suggestive of a V-shaped opening with a closed apex. Of course, many other shapes and patterns of light apertures may be used to project or control the visibility of a target 26 within regions 20. Moreover, a colored rod, such as an elongated beam or pole painted with brightly colored fluorescent or "day glow" type paint, may be used as a low cost substitute for a light source. Light reflective or shiny surfaces or coatings can also be applied to the target 26 as a substitute or in addition to a light source 60.

FIGS. 8 through 11 provide some dimensions, in inches, of a representative embodiment of the targeting system of FIGS. 3 through 7 and show the system in different views. The apertures 70, 72 are not shown in these views as the apertures can be formed as clear portions of an opaque solid plastic panel or housing and not visible until the internal aiming target 26 is illuminated.

Figure 12:
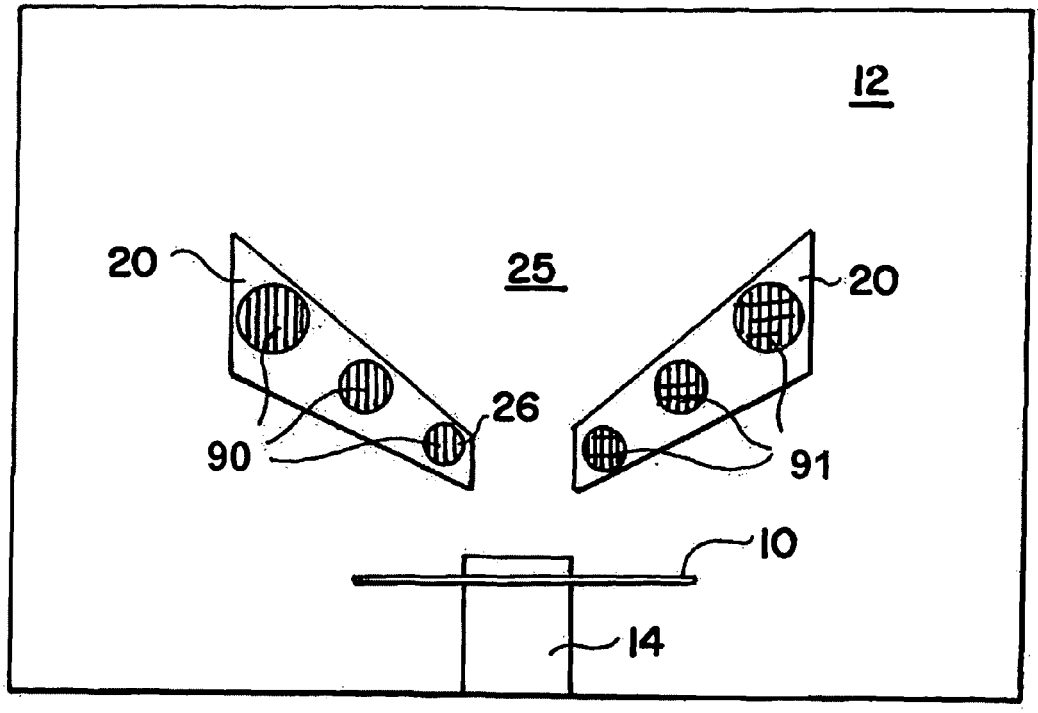
FIG. 12 is a front elevation view of another embodiment of a basketball aiming target having planar arrays of vertical lenses applied directly to a backboard.

Another embodiment of the invention is shown in FIG. 12, where the regions 20 are applied as a lenticular sheet or covering directly on the surface of backboard 12, either on the front surface preferably on the rear surface of the backboard. The individual lenses such as linear, vertically-extending lenses 91, similar to those on Fresnel lenses can be formed on a single sheet of plastic lens material and applied as a single covering on the front or behind the backboard to provide and define both regions 20, or as a series of separate lenses 91 applied to the backboard individually. Any conventional mounting method can be used, such as adhesives, clips, tape or threaded fasteners and brackets. Each lens is aligned at a slightly different angle to provide visibility to a player located on a predetermined position on the court. As a player moves across the court, different lenses will become visible or transparent to the player, thereby revealing a single elongated lens or revealing several adjacent lenses as a desired target for a proper bank shot.

It is also possible to manufacture the backboard with integral lenticular target regions 20. Each target within target region 20 is only visible when a player is located on an area of the court where the target region provides an appropriate target for a bank shot. Of course, target regions can be also applied as individual opaque or semi-opaque appliques or "patches" 90. In this example, the aiming target 26 is optional or eliminated.

The targeting systems described above can be provided as retrofit systems, or as original equipment, depending on the system used. The system of FIG. 2 is primarily for original equipment applications, while the "stand-alone" system of FIG. 3 can be used with new or existing backboards. The system of FIG. 12 can be used with original equipment or as a retrofit.

Although regions 20 as described above have been derived mathematically, it is also possible to derive similar target regions empirically based on preferences of basketball coaches, players and others. This empirical approach can focus on parabolic arcs and the principal of the imaginary arcs as given starting points. The lateral or horizontal boundaries of each target region 20 can then be adjusted as desired, and the vertical boundaries of each target region 20 can also be adjusted as desired based on other factors such as entry angle, player distance, and player height which combine to create a range of acceptable target regions. Additional room for modifying the target regions 20 can be based on the fact that a regulation basketball has about a nine inch diameter and the hoop has an eighteen inch diameter.

This adjustment or modification of the target regions 20 to suit different shooting preferences can be made by providing adjustable shutters on the apertures 70, 72 (such as used in cameras) so that the size and shape of each aperture can be varied as desired by moving the shutters over the apertures, thereby adjusting the size and shape of each target region 20. Overlays with different shaped target regions 20 can also be selectively applied to the backboard in the form of a set of various overlay sheets, tape strips, as well as erasable paint or erasable markers and the like.

Figure 13:
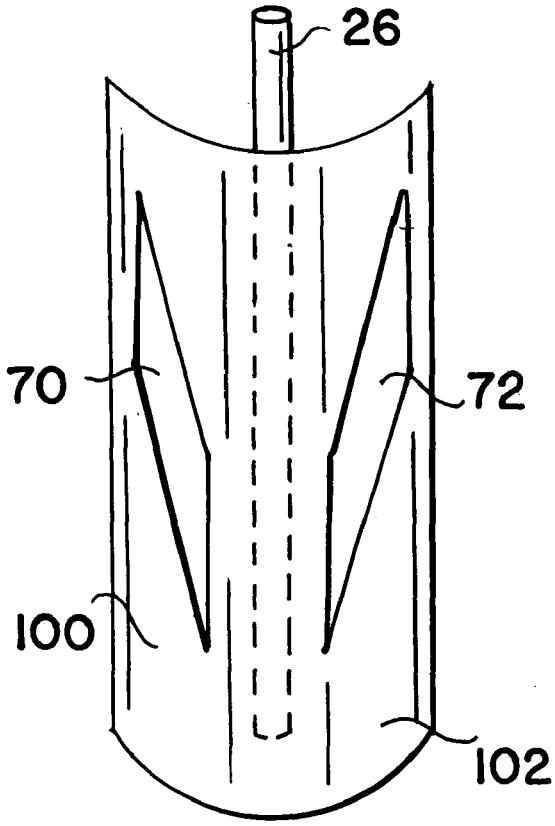
FIG. 13-15 are schematic view of additional embodiments of basketball aiming targets that can be used with or without an illuminated light source.
Figure 14:
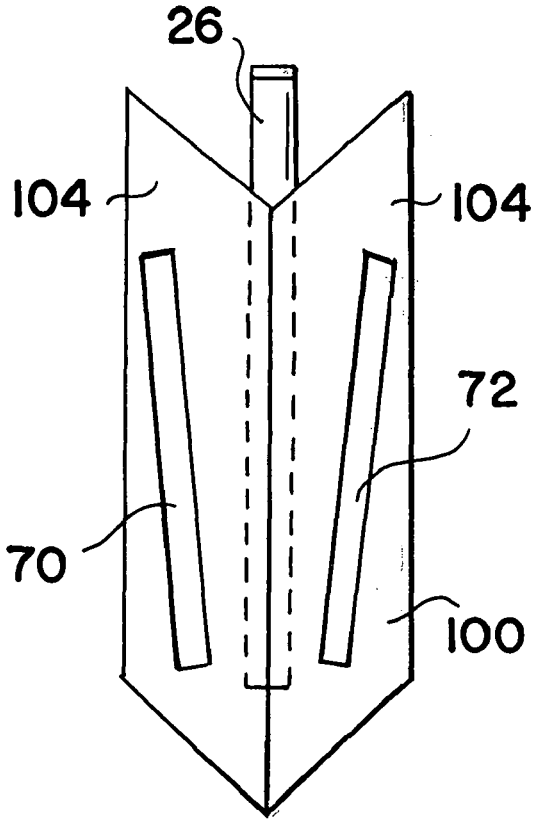
Figure 15:
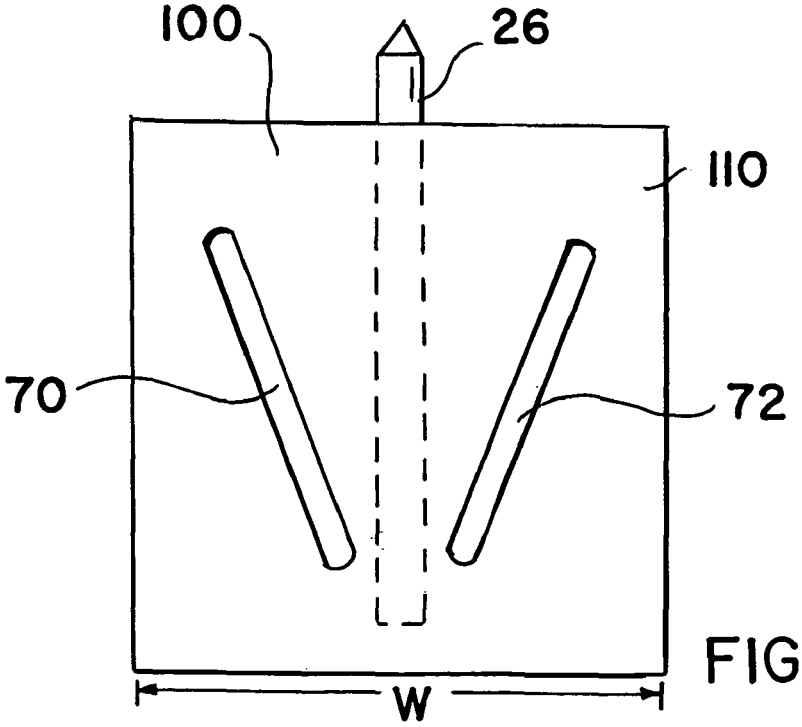

Additional embodiments of a simplified form of targeting system are shown in FIGS. 13-15. In these embodiments, an enclosed outer housing, such as outer housing 32 in FIG. 3, is replaced with a simple apertured mask or shroud 100. Mask 100 can be formed of a thin sheet of metal, plastic, wood, fabric, cardboard or any other opaque material.

Light passages 70, 72 can be formed as apertures, slots, or cut-out regions in mask 100 to allow for selective visibility of the aiming target 26. In FIG. 13, mask 100 is formed with a curved convex front surface 102, and aiming target 26 is formed as a cylindrical rod mounted symmetrically behind the center of mask 100.

In FIG. 14, mask 100 is formed as a V-shaped curtain with flat rectangular side walls 104 having light passages 70, 72 formed as simple rectangular slots diverging upwardly and laterally outwardly from the central bottom portion to the top lateral side portions of the mask 100. The aiming target 26 can take the form of a brightly colored bar having a rectangular cross section.

As shown in FIG. 15, the mask 100 can be a simple planar panel 110 having a greater width W than the previous embodiments so as to provide sufficient lateral masking of the aiming target 26. The aiming target 26 can be of any elongated shape, such as the triangular rod shown in FIG. 15.

FIG. 16 shows a schematic representation of one mounting arrangement for mounting any one of the masks of FIGS. 13-15 as well as the system 30 of FIG. 3. In this example, a bracket 112 is mounted to the back of backboard 12 in any suitable manner, such as with screws, bolts, clamps, adhesives and the like. A central horizontal mounting bar 114 supported by bracket 112 extends rearwardly along a line bisecting hoop 10. The aiming target 26 can be vertically adjustably mounted to the mounting bar 114 with an adjustable clamp ring 116, such as used to adjust the height of a bicycle seats. Alternatively, the mask 100 can be vertically adjustably mounted to the mounting bar 114 along a vertical support pole 118 using an adjustable clamp 120, such as clamp ring 116.

There has been disclosed heretofore the best embodiment of the invention presently contemplated. However, it is to be understood that various changes and modifications may be made thereto without departing from the spirit of the invention.

What is claimed is:

1. A basketball aiming system for use with a basketball backboard having a pair of opposite sides and a basketball hoop located centrally between said opposite sides, said system comprising:

a first target region visible on a first side of said basketball hoop and a second target region visible on a second side of said basketball hoop;

said first and second target regions diverging away from each other and extending above said basketball hoop;

said first and second target regions respectively extending vertically upwardly and horizontally outwardly toward said opposite sides of said basketball backboard, such that each target region increases in vertical height as viewed from a central portion of said backboard moving horizontally outwardly from said basketball hoop towards said sides of said backboard; and said first and second target regions defining a horizontal and a vertical range of an aiming target within which a successful bank shot can be made.

2. The aiming system of claim 1, wherein said first and second target regions are located on said backboard.

3. The aiming system of claim 1, wherein said backboard is transparent and wherein said first and second target regions are located behind said backboard.

4. The aiming system of claim 1, wherein said backboard is transparent and wherein said aiming target comprises an illuminated target located behind said backboard.

5. The aiming system of claim 1, wherein said aiming target visually moves vertically when viewed by a player moving laterally with respect to said backboard.

6. The aiming system of claim 1, wherein said backboard is transparent and, wherein each of said first and second target regions are defined by a planer mask.

7. The aiming system of claim 3, wherein said first and second target regions are defined by a light box.

8. The aiming system of claim 1, wherein said first and second target regions comprise lenses.

9. The aiming system of claim 1, wherein said first and second target regions are arranged in a wing-like open V-shaped configuration.

10. The aiming system of claim 1, wherein said first and second target regions are removable from said backboard.

11. The aiming system of claim 1, wherein each of said first and second target regions comprises a plurality of spaced apart target areas.

12. The aiming system of claim 1, wherein said backboard is transparent and wherein said first and second target regions are defined by a curved mask located behind said backboard.

* * * * *